US005943389A

United States Patent [19]

Lee

[11] Patent Number: 5,943,389

[45] Date of Patent: Aug. 24, 1999

[54] X-RAY TUBE ROTATING ANODE

[75] Inventor: David S. Lee, Salt Lake City, Utah

[73] Assignee: Varian Medical Systems, Inc., Palo Alto, Calif.

[21] Appl. No.: 09/036,575

[22] Filed: Mar. 6, 1998

[51] Int. Cl.[6] ..... H01J 35/10

[52] U.S. Cl. ..... 378/144; 378/143

[58] Field of Search ..... 378/143, 144, 378/127, 128

[56] References Cited

U.S. PATENT DOCUMENTS

| | | | |
|---|---|---|---|
| 4,525,417 | 6/1985 | Dimigen et al. | 428/244 |
| 4,689,810 | 8/1987 | Devine, Jr. | 378/144 |
| 4,958,364 | 9/1990 | Guerin et al. | 378/144 |
| 5,138,645 | 8/1992 | Penato et al. | 378/144 |
| 5,155,755 | 10/1992 | Penato et al. | 378/143 |
| 5,159,619 | 10/1992 | Benz et al. | 378/143 |
| 5,875,228 | 2/1999 | Truskowksa | 378/144 |

*Primary Examiner*—David P. Porta
*Assistant Examiner*—Michael J. Schwartz
*Attorney, Agent, or Firm*—Bella Fishman

[57] ABSTRACT

A new target anode for use in x-ray equipment where it is subjected to high speed rotations and thermal stress, wherein the target anode is comprised of a substrate which has coated thereon an x-ray emissive, high-Z metallic material or metal carbide which functions as the focal track, wherein a surface on the substrate to which the high-Z metallic material or metal carbides is deposited and bonded consists of directionally oriented fibers of high thermal conductivity, and wherein the directionally oriented fibers are bonded to the substrate and facilitate bonding between the substrate and the x-ray emissive, high-Z metallic material or metal carbide.

25 Claims, 3 Drawing Sheets

X-RAY TUBE ROTATING ANODE

FIELD OF THE INVENTION

The present invention relates generally to x-ray tube technology and, in particular, to an x-ray tube rotating anode structure with improved performance characteristics which enable the rotating anode to have an increased lifespan because of reduced internal stresses.

The conventional x-ray tube rotating target anodes suffer from drawbacks which are a result of the anisotropic properties of the materials used in their construction. The inherent limitations of the anisotropic materials cause the rotating target anodes suffer fatigue from thermal expansion mismatch.

X-ray tubes with rotating anodes are used to generate x-rays. This is accomplished by bombarding the target material on the rotating anodes with high energy electrons. Typically, the target materials are refractory metals such as, tungsten, molybdenum or alloys thereof.

Only a small surface area of the target is bombarded with electrons. This small surface area is referred to as a focal spot, and forms a source of x-rays. The high levels of instantaneous power delivered to the target, combined with the small size of the focal spot, has led designers of x-ray tubes to cause the target anode to rotate, thereby distributing the thermal flux throughout a larger region of the target anode. There are various techniques for distributing thermal flux, for example, faster rotation speeds or greater target anode diameters, that allows for decreasing the thermal energy at any given location along the focal track.

However, there is a practical limitation regarding a maximum speed at which the target anode can be rotated, and in the size of practical target anode diameters. The materials of the target anode will eventually shatter at certain speeds and larger diameters.

Different designs of the target anodes are used in an attempt to decrease thermal stresses. All such designs include a base or substrate, generally in the form of a disk. At this point, however, the designs diverge in construction.

FIG. 1 shows a profile cross-sectional view of a state of the art target anode 10 which includes a substrate 12. The substrate 12 is typically composed of a carbon material (e.g. graphite). A graphite material has excellent characteristics of heat capacity per unit mass, though they are relatively fragile. Alternatively, a carbon—carbon composite material can be used for substrate. The carbon—carbon composite material is a fibrous fabric formed by a two or three dimensional interlacing of carbon fibers, the mesh of which is then filled with a carbon matrix, wherein carbon fabric and carbon matrix materials form the composite. The carbon—carbon composite is notable for its favorable thermal and mechanical properties.

The substrate 12 is coupled to a metal cap 14. The metal cap 14 is typically comprised of a molybdenum alloy such as titanium zirconium molybdenum (TZM*) * TZM is trademark of Metallwork Plansee. Typically, the substrate 12 and the metal cap 14 are brazed together, forming brazed joint 16. On an outer edge of the metal cap 14 which forms a focal track, a layer of an x-ray emissive target material 18 is deposited. The x-ray emissive material is typically tungsten or other similar materials or alloys. In general, the layer of target material on the metal cap 14 is formed by power metallurgy process (P/M).

It should be evident from the description of FIG. 1 that the target anode 10 is comprised of different layers of materials.

Disadvantageously, the materials are dissimilar, and therefore have different thermal expansion characteristics. While the materials are selected to be as close as practical in their thermal characteristics, differences are inevitable. As a result of this thermal expansion mismatch, the metal cap 14 tends to separate from the substrate 12 as the braze joint 16 weakens from thermal fatigue. The braze joint 16 can thus develop cracks which can result in catastrophic failure of the target anode 10.

FIG. 2 illustrates another conventional target anode in a cross-sectional profile view. The target anode 20 is comprised of the substrate 22 and an x-ray emissive target material 24 which is deposited thereon. The x-ray emissive target material 24 in this type of target anode is deposited using a technique such as chemical vapor deposition (CVD) or physical vapor deposition (PVD).

Since there is no braze joint to weaken, the target anode 20 should be less sensitive to thermal stresses. However, it is still subject to the thermal stresses which are inherent to the materials where the x-ray emissive target material 24 is coupled to the substrate 22. It is the closer proximity of interface between x-ray emissive target material and graphite (or other carbon-bearing material) to the focal spot that results in high thermal stresses at the interface. Consequently, delamination of the x-ray emissive target material 24 from the substrate 22 is still a problem.

Thermal management is critical in a successful target anode, since over 99 percent of the energy delivered to the target anode is dissipated as heat, while significantly less than 1 percent of the delivered energy is converted to x-rays. Given the relatively large amounts of energy which are typically conducted into the target anode, it is understandable that the target anode must be able to efficiently dissipate heat.

Accordingly, it would be an advantage over the state of the art to provide a target anode structure and material which is capable of high speeds of rotation, and which is less sensitive to thermal stresses. It would also be an advantage to provide a new method of creating a layer of x-ray emissive material on a target anode substrate which would not be subject to delamination.

SUMMARY OF THE INVENTION

It is an object of the present invention to provide a target anode for use in x-ray equipment which withstands the effects of thermal fatigue.

It is an advantage of the present invention that the target anode incorporates an x-ray emissive material into a top layer of the substrate to thereby reduce the possibility of delamination of the x-ray emissive material.

It is another advantage of the present invention that the target utilizes an x-ray emissive material for the focal track which has improved heat transfer characteristics with a substrate into which it is incorporated, in accordance with the nature of its bond with the substrate.

It is yet another advantage of the present invention that the target provides an interface surface between a substrate and an x-ray emissive material which facilitates a bond between the x-ray emissive material and the substrate.

It is yet another advantage of the present invention that the target anode provides a surface on a substrate which facilitates the integration of particles of the x-ray emissive material into the substrate which facilitates the infiltration of an x-ray emissive material to be filled in throughout the hair-like projections.

The present invention is realized in a target anode for use in x-ray equipment where it is subjected to high speed rotations and thermal stress, wherein the target anode is comprised of a substrate which has coated thereon an x-ray emissive, high-Z metallic material which functions as the focal track, wherein a surface on the substrate to which the high-Z metallic material is coated comprises of directionally oriented carbon fibers of high thermal conductivity, and wherein the directionally oriented carbon fibers are bonded to the substrate and facilitate bonding between the substrate and the x-ray emissive, high-Z metallic material. The directionally oriented carbon fibers are formed of the same highly conductive material as the substrate. The diameters of the directional oriented fibers may be varied.

To reduce a reaction with fibers that may take place between the carbon fibers and high-Z material, a diffusion barrier is provided which enhances the integrity of the directionally oriented fibers.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention. It is to be understood that the following description is only exemplary of the principles of the present invention, and should not be viewed as narrowing the claims which follow.

The preferred embodiment of the present invention is a structure for an x-ray anode for use in diagnostic x-ray equipment which provides improved thermal management. According to the present invention, it is necessary to combine at least two materials having different thermal characteristics in an x-ray anode, (the x-ray emissive material and the material of a substrate to which the x-ray emissive material is mounted), and improve bonding therebetween and consequently extend the life of the x-ray anode.

Figure 1:
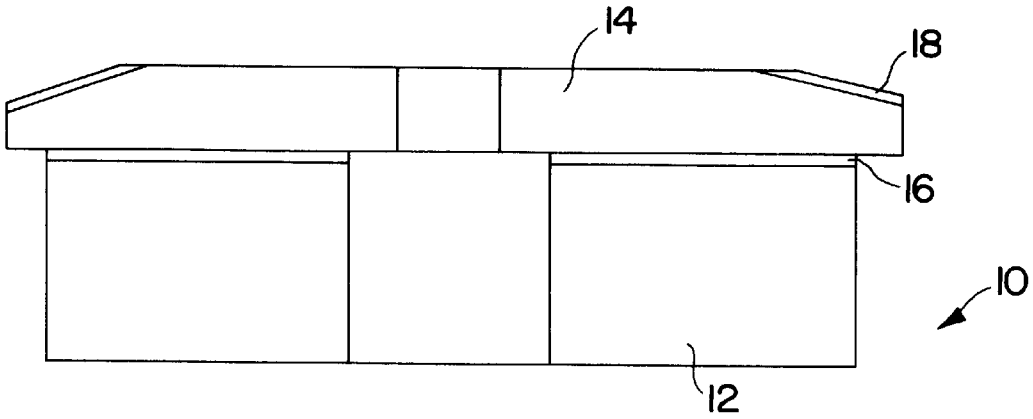
FIG. 1 PRIOR ART
FIG. 1 is a profile cross-sectional view of a state of the art target anode which includes a substrate, where the substrate 12 is typically composed of a carbon material (e.g. graphite).
Figure 2:
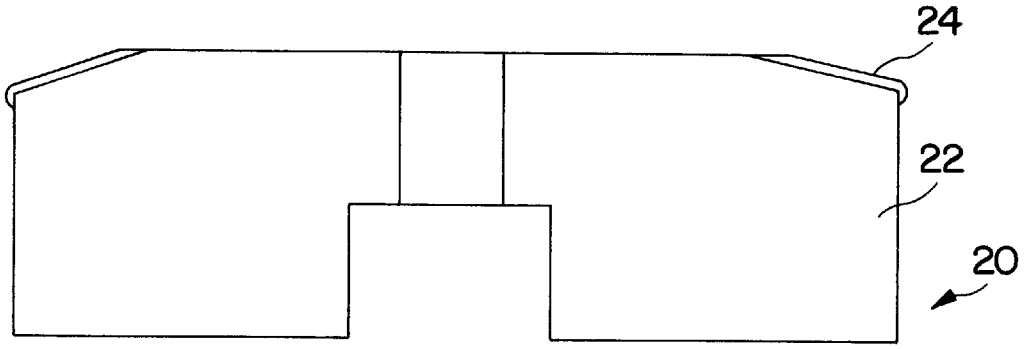
FIG. 2 PRIOR ART
FIG. 2 illustrates another state of the art target anode in a cross-sectional profile view, where the target anode is comprised of a substrate and an x-ray emissive target material 24 deposited thereon.
Figure 3:
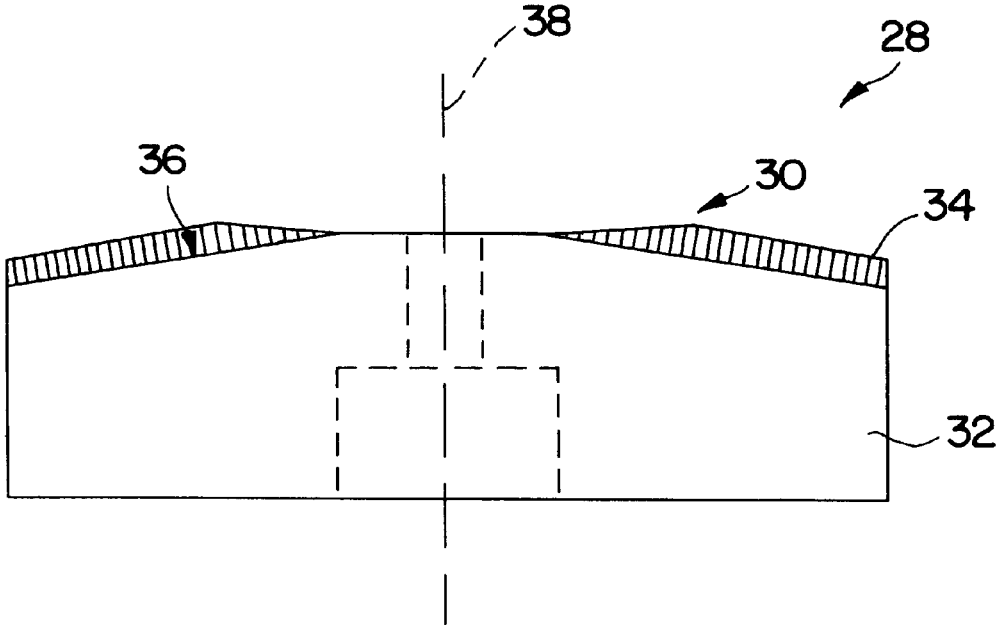
FIG. 3 is an illustration of the presently preferred embodiment which is constructed in accordance with the principles of the present invention. The x-ray anode is a composite structure comprised of a carbon—carbon substrate which has bonded to a high-Z metal material which forms a track. The substrate includes a plurality of directionally oriented carbon fibers which have bonded to the carbon—carbon substrate by a CVD process and which enhance bonding of the high-Z metal material to the carbon—carbon substrate.

FIG. 3 illustrates the preferred embodiment of the present invention. The x-ray anode 28 is a composite structure comprised of a carbon—carbon substrate 32 (to be referred to hereinafter as a carbon substrate) which has bonded to a target material 34 which is a high-Z metal material (shown in an exaggerated size relative to the substrate 32) which forms a focal track. An integral element of the present invention is the use of a novel mechanism for bonding the high-Z target material 34 to the carbon substrate. In essence, the carbon substrate 32 is bonded with carbon fibers by an appropriate process. In this preferred embodiment, bonding is accomplished by a CVD process or by carbonizing a bonding material between fibers and carbon substrate.

The carbon substrate 32 is formed as a disk from a carbon—carbon composite material. A carbon—carbon composite refers to carbon fibers 30 (shown in FIG. 3) having an exaggerated height which are held together by a carbon matrix of the carbon substrate which generally fills the gaps between the carbon fibers. The carbon fibers can be of a woven or unwoven variety, thereby providing different characteristics of performance. The carbon substrate 32 has a substrate base surface 36 formed as a generally concentric circle centered about an axis of rotation 38. The substrate base surface 36 has disposed thereon a plurality of directionally oriented fibers 30 which form a densely populated fiber structure to which the high-Z target material 34 is bonded (shown in greater detail in FIGS. 4, 5A, 5B and 5C). The target material 34 is formed using such metals as W, W/Re, HfC, TaC, ZrC, NbC, or other metals or metal carbides, or a combination thereof and selected by those skilled in the art who are familiar with appropriate choices for a high-Z metal for use in x-ray anodes.

As mentioned above, the fiber structure is comprised of a plurality of directionally-oriented, carbon fibers 30. The carbon fibers 30 have a high thermal conductivity (e.g. 400 to 1000 W/m-K or higher). Any appropriate method can be used which results in the desired carbon fiber structure, such as bonding or implanting. It is important that the plurality of directionally oriented fibers be provided on the substrate base surface 36.

Figure 4:
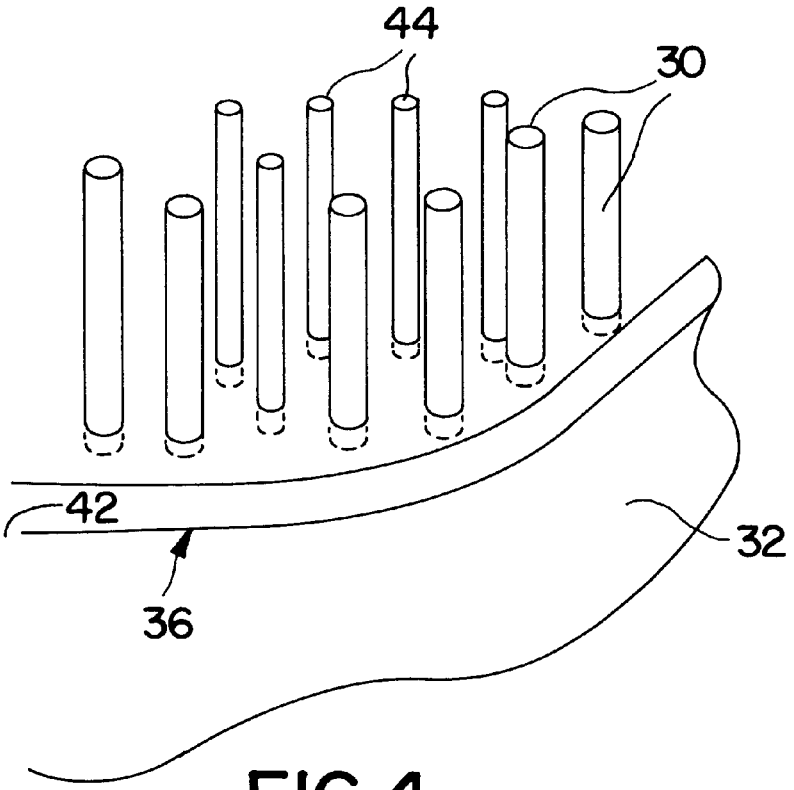
FIG. 4 is a possible representation of how the directionally oriented carbon fibers can appear on the surface of the carbon substrate, where the carbon fibers are generally oriented perpendicularly relative to the surface of the carbon substrate.

FIG. 4 provides a close-up representation of such a carbon fiber structure. In this view, a bonding method was selected for providing the carbon fibers 30 on the substrate base surface 36. Accordingly, a carbon-bearing bonding material 42 is shown at the base of each carbon fiber 30 where it is attached to the substrate base surface 36. The carbon fibers 30 resemble hair-like fibers or strands which generally extend perpendicularly away from the substrate base surface 36 of the carbon substrate 32. The carbon fibers 30 are located close together and generally evenly distributed across the surface of the substrate 32. The distribution of the carbon fibers 30 and their orientation relative to the substrate base surface 36 can vary within certain parameters. Bonding of fibers to the substrate takes place during carbonizing the bonding material in high temperature, high vacuum furnace environment.

The benefits obtained from the fiber structure are likely to be obtained from even more random distributions and orientations of the carbon fibers 30 relative to the target surface 36. In other words, the carbon fibers 30 could all be slanted to some degree (e.g., 3 to 10 degrees) relative to the substrate surface 36 and still provide excellent bonding between the substrate 32 and the metal focal track to be deposited and bonded thereon.

The scale of FIG. 4 is chosen for illustrative purposes. The thickness of the substrate 32 is likely to be much greater in comparison to the thicknesses of the carbon fibers 30 shown. Furthermore, the length of the carbon fibers 30 is also probably much greater, and the thickness of the bonding material 42 is also likely to vary somewhat from what is shown. FIG. 4 is intended to show the elements of the present invention, while more precise object size ranges are described later.

When considering the beneficial characteristics of using the fiber structure as a method for increasing bonding strength, at least four characteristics stand out. First, there should be a sufficient number of carbon fibers present. Second, the carbon fibers should have a desirable size (width). Third, the carbon fibers should extend a sufficient distance away from the substrate base surface 36 so that there is some "depth" to the carbon fibers thus creating a sufficiently large transition zone. Fourth, a packing density, or a number of fibers in a given area on the substrate surface, should also be relatively high. In effect, all of these characteristics are related to the mechanical aspects of providing a sufficiently large number of fibers to which the metal material forming the focal track can bond.

More specifically in the preferred embodiment, the x-ray anode utilizes a minimum coating of high-Z materials necessary for x-ray output requirements. These requirements, however, can vary with the x-ray anode applications. For example, the thickness of the metal material coating may vary from tens of microns to a few hundred microns.

Regarding the carbon fibers 30 themselves, it is also important that although the carbon fibers 30 have been shown having relatively uniform cylindrical shapes, the fibers can be somewhat irregular to roundness in cross-section. For example, the top 44 of each carbon fiber 30 could be jagged, rounded or as shown in FIG. 4, have a relatively smooth and flat structure. The length of the carbon fibers 30 can vary from 0.003 to 0.030 inches. Suitable carbon fibers can also vary in diameter, and for a high packing density, a combination of several diameter sizes are possible. Typically, the fibers are between 8 and 12 microns in diameter, and have a length of approximately 0.010 to 0.015 inches. Furthermore, in this preferred embodiment, the fiber density varies from 10% to 40%, with the remaining space filled with the high-Z metals or carbides.

The target material 34 is generally able to fill most gaps between the fibers 30, and even reach the substrate base surface 36. The high packing density does imply, however, that the fibers 30 are generally parallel to each other.

The use of carbon fibers for the anode structure takes advantage of the high thermal dissipation characteristics of carbon. Furthermore, there are minimal thermal expansion differences between the substrate and the fibers, dependent upon the substrate structure.

After the fiber structure has been formed, the high-Z target material 34 is deposited thereon. The target material 34 is bonded to the fiber structure by applying heat or by other methods which are known to those skilled in the art such as CVD or PVD processes. The target material 34 is selected for the property of being x-ray emissive when subjected to high energy electron bombardment.

It is a characteristic of the possible target materials that when the target anode 20 is in use, the target materials will react with the carbon substrate 32 to form carbides. When tungsten (or tungsten-3 to 10% rhenium alloy) is used as the target material 34, the result is likely to form tungsten-carbide. As a result of this reaction the mechanical strength of the carbon fibers 30 may be diminished.

Figure 5A:
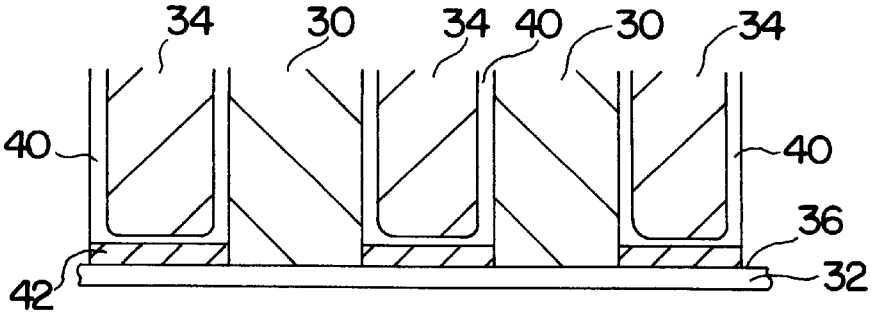
FIG. 5A illustrates the concept of providing a diffusion barrier between the high-Z metal target material and the plurality of directionally oriented carbon fibers.

FIG. 5A shows that to maintain the strength of fibers, according to another aspect of the present invention, a carbon diffusion barrier 40 is provided to enhance the integrity of the directionally oriented fibers 30. The diffusion barrier 40 is deposited and bonded to the carbon fibers 30 before the target material 34 is deposited and bonded to the carbon fibers 30. FIG. 5A shows that the carbon fibers were bonded to the substrate surface 36, then the diffusion barrier 40 was applied to the carbon fibers 30, and then the target material 34 was applied. The bonding material 42 is generally a carbonized bonding layer, where the precursor is a carbon bearing material.

The diffusion barrier 40 can function in two different ways depending on the choice of materials forming this barrier. The first method of operation is when the diffusion barrier 40 prevents a reaction between the target material 34 and the carbon fibers 30. The second method of operation is to use a material for the diffusion barrier which will interact with the additional carbon layer protecting carbon fibers 30 from reaction.

In the presently preferred embodiment, the diffusion barrier 40 is about a 3 to 5 micron layer of rhemium, a non-carbide forming metal. Any high temperature, non-carbide forming metal may be used in place of rhenium, and other thicknesses may be applied. Advantageously, however, rhenium can also be used as a high-Z target material. Accordingly, the diffusion barrier can also be a carbide forming metal which by its own structure induces a least amount of stress on a carbon lattice of the carbon layer and substrate 32.

Other criteria for the selection of a material functioning as a diffusion barrier is that it should not grossly interfere with the transfer of heat energy from the target material 34 to the fibers 30 or the substrate 32.

Figure 5B:
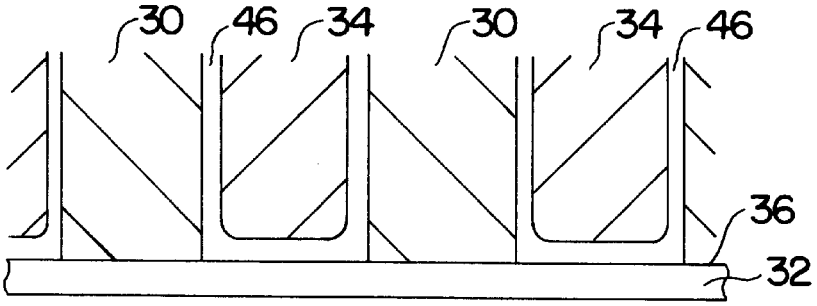
FIG. 5B is an alternative embodiment of FIG. 5A where a CVD carbonized layer is used to secure the carbon fibers to the substrate, and where no diffusion barrier is applied.

FIG. 5B is provided as an alternative embodiment for the specific structure of the carbon fibers 30 on the substrate 32. This figure shows that instead of using a bonding material between the carbon fibers 30 and the substrate 32, the carbon fibers are bonded to the substrate utilizing a diffusion barrier 46. The diffusion barrier 46 can be a CVD deposited carbon layer. Then the high-Z target material 34 is applied.

Figure 5C:
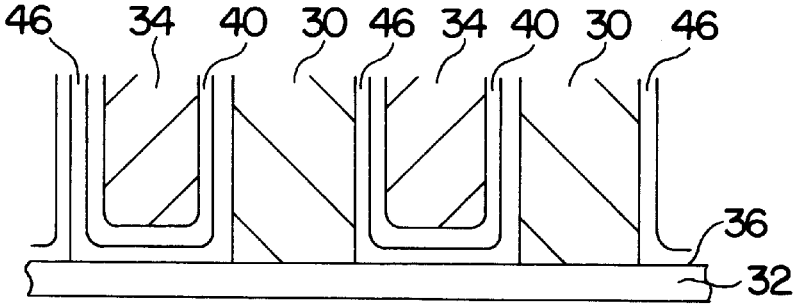
FIG. 5C is an alternative embodiment of FIG. 5B where a diffusion barrier is added to the carbon fibers after application of the CVD carbonized layer and before application of the target material.

FIG. 5C is another alternative embodiment of the present invention. It is basically a combination of the embodiments shown in FIGS. 5A and 5B. Specifically, the carbon fibers 30 are bonded to the substrate 32 using the CVD applied carbon layer 46. In contrast to FIG. 5B, the diffusion barrier 40 is then applied. The diffusion barrier 40 in this alternative embodiment is rhemium. Finally, the target material 34 is applied.

The method of manufacturing an x-ray anode which is suitable for use in diagnostic x-ray equipment comprises the following basic steps. The first step is to form a substrate having a surface formed as a generally concentric circle centered about an axis of rotation. The second step is to form the plurality of directionally oriented fibers on the target surface utilizing any of the methods described herein, or others which create an equivalent fiber structure. The third step is to deposit and bond the target material to the plurality of directionally oriented fibers to thereby form the target surface.

Figure 6:
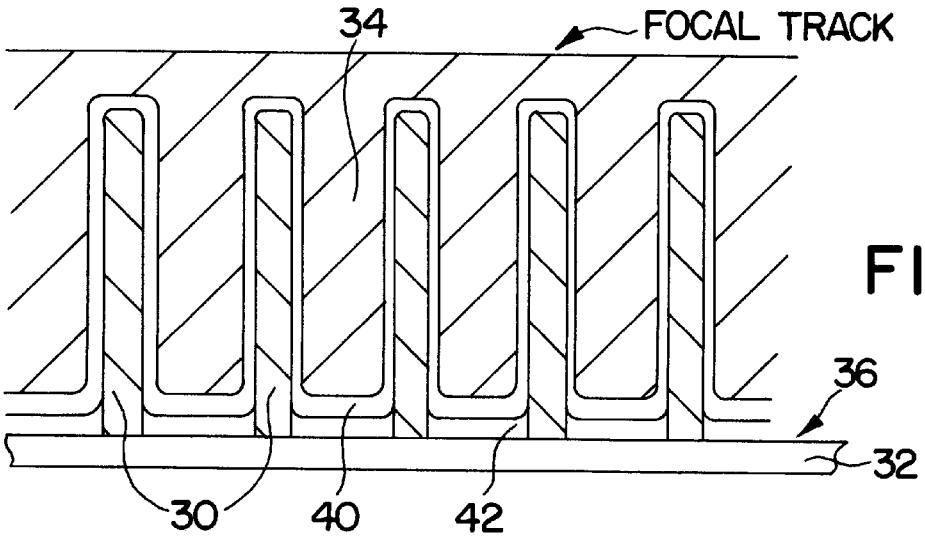
FIG. 6 illustrates an embodiment where the directionally oriented carbon fibers with diffusion barriers therebetween and high-Z material coded the top of these fibers are deposited to the surface of the carbon—carbon substrate.

The advantages of this method include preventing delamination of the target material from the substrate by depositing the target material fully into the fiber structure and/or then fully cover the top surface of the fibers with the target material, as shown in FIG. 6. The bond is formed through coherent, metallurgical or mechanical bonding to the carbon fiber structure, dependent upon the diffusion barrier material. The method also inhibits carbide formation that weakens of carbon fibers by providing a diffusion barrier between the fibers and the target material. The diffusion barrier can be a carbide forming metal which has a lattice structure which poses a relatively small degree of stress on the carbon lattice of the fiber structure and the substrate. The composite layer of carbon fibers and high-Z material on the substrate surface 36 provides an effective buffer zone that diffuses stresses between two dissimilar materials. Such a composite structure helps reduce the formation of critical stresses for fracture or delamination of the focal track of the substrate 32.

A design consideration which should be taken into account when selecting a material to be used in the diffusion barrier is that it should enhance the composite structure of the x-ray anode. This is achieved mainly through obtaining required bonding characteristics between the substrate 32 and the target material 34.

Similarly when selecting a carbon—carbon substrate, an important characteristic is that it functions as a heat sink possessing high thermal conductivity to dissipate the heat from the target material 34 throughout the substrate 32 and in all directions. Among the existing structures of carbon—carbon composites, a CVD composite of non-woven structure would be most suitable for the preferred embodiment because of its relatively uniform, high thermal conductivity and a very coherent fiber-to-matrix structure rendered by a CVD manufacturing process.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A rotatable anode for X-ray tube having an axis of rotation comprising:

a substrate formed of a carbon—carbon material and comprising a substrate base surface;

a plurality of directionally oriented fibers being deposited onto said substrate base surface; and a target formed on said substrate base surface covering said plurality of directionally oriented fibers, said target comprising a target material, said target material is bonded to said plurality of directionally oriented fibers.

2. The rotatable anode for X-ray tube of claim 1, wherein said substrate base surface is shaped as a substantially concentric circle centered about said axis of rotation and extending from a proximal radius relative to said axis of rotation to a distal radius relative to said axis of rotation.

3. The rotatable anode for X-ray tube of claim 2, wherein said plurality of directionally oriented fibers are formed of carbon fibers which are bonded to said substrate base surface.

4. The rotatable anode for X-ray tube of claim 3, wherein said carbon fibers are spaced therebetween to enable said target material to infiltrate therethrough so as at least a portion of said target material is in contact with said substrate.

5. The rotatable anode for X-ray tube of claim 4, wherein said carbon fibers are substantially parallel to each other and substantially perpendicular to said substrate base surface.

6. The rotatable anode for X-ray tube of claim 5, wherein said target material is selected from the group of high Z materials consisting of W, W/Re, HfC, TaC, ZrC, and NbC.

7. The rotatable anode for X-ray tube of claim 6, wherein said carbon fibers are bonded to the high Z material by a process of carbonizing a bonding material between the plurality of fibers and the carbon substrate and subsequent carbon CVD process.

8. The rotatable anode for X-ray tube of claim 7, further comprising a layer of non-carbide forming material which is deposited to said directionally oriented fibers for providing a diffusion barrier between neighboring directionally oriented fibers.

9. The rotatable anode for X-ray tube of claim 8, wherein said layer of non-carbide forming material is Re.

10. The rotatable anode for X-ray tube of claim 9, wherein said layer of non-carbide forming material is deposited to said carbon fibers at a thickness of about three to five microns.

11. The rotatable anode for X-ray tube of claim 8, further comprising a layer of carbonized material for bonding said carbon fibers to said substrate.

12. The rotatable anode for X-ray tube of claim 7, further comprising a layer of a carbide forming material which is deposited to said directionally oriented fibers for providing a diffusion barrier between neighboring directionally oriented fibers.

13. The rotatable anode for X-ray tube of claim 12, wherein said layer of carbide forming material is coated by a layer of non-carbide forming material.

14. The rotatable anode for X-ray tube of claim 13, wherein said layer of carbide forming material is selected from the group of high-Z carbide materials consisting of HfC, TaC, ZrC, and NbC, and said non-carbide forming metal is Re.

15. The rotatable anode for X-ray tube of claim 3, wherein said carbon fibers have a length which is generally less than 0.03 inches.

16. The rotatable anode for X-ray tube of claim 3, wherein said carbon fibers are formed having a plurality of diameters of different size to facilitate a high packing density on said substrate base surface.

17. The rotatable anode for X-ray tube of claim 3, wherein the diameter of each said carbon fiber is in a range of 8 to 12 microns.

18. The rotatable anode for X-ray tube of claim 1, wherein said plurality of directionally oriented fibers are formed on said substrate base surface having a fiber density of ten to forty percent, with a remaining space between said fibers filled with said target material.

19. The rotatable anode for X-ray tube of claim 1, wherein said target material is disposed on said plurality of directionally oriented fibers to a depth of up to approximately 0.04 inches.

20. A rotatable anode for X-ray tube having an axis of rotation comprising:

a substrate formed of a carbon—carbon material and comprising a substrate base surface, said substrate surface being a substantially concentric circle centered about the axis of rotation extending from respective proximal to distal radii relative to said axis of rotation;

a plurality of directionally oriented fibers being deposited onto said substrate base surface;

a target formed on said substrate base surface covering said plurality of directionally oriented fibers, said target comprising a high Z target material, said target material is bonded to said plurality of directionally oriented fibers; and an intermediate layer of a carbide forming material deposited between said plurality of directionally oriented fibers and said target material.

21. The rotatable anode for X-ray tube of claim 20, wherein said plurality of directionally oriented fibers are formed of carbon fibers.

22. The rotatable anode for X-ray tube of claim 21, wherein said intermediate layer is coated by non-carbide forming material, said layer of non-carbide forming material is adjacent to said target material.

23. A rotatable anode for X-ray tube having an axis of rotation comprising:

a substrate formed as a disk comprising of a carbon—carbon material and having a substrate base surface;

a plurality of directionally oriented carbon fibers being deposited onto said substrate base surface;

a target formed on said substrate base surface covering said plurality of directionally oriented fibers, said target comprising a high Z target material, and an intermediate layer of a non-carbon forming material deposited between said plurality of directionally oriented fibers and said target material, said intermediate layer being bonded to said target material and forming a diffusion barrier limiting formation of carbides resulting from between said carbon fibers and said target material.

24. The rotatable anode for X-ray tube of claim 23, further compirsing a carbonized layer deposited to said substrate base surface for bonding said carbon fibers thereto.

25. The rotatable anode for X-ray tube of claim 24, wherein said carbon—carbon substrate is at least partially comprised of a non-woven carbon fiber.

* * * * *